US009435128B2

(12) United States Patent
Kreller

(10) Patent No.: US 9,435,128 B2
(45) Date of Patent: Sep. 6, 2016

(54) OVERLAP ARRANGEMENT OF AT LEAST TWO DECKING PLANKS

(71) Applicant: Wilhelm Layher Verwaltungs-GmbH, Gueglingen-Eibensbach (DE)

(72) Inventor: Helmut Kreller, Bad Rappenau (DE)

(73) Assignee: Wilhelm Layher Verwaltungs-GmbH, Gueglingen-Eibensbach (DE)

( * ) Notice: Subject to any disclaimer, the term of this patent is extended or adjusted under 35 U.S.C. 154(b) by 189 days.

(21) Appl. No.: 13/834,419

(22) Filed: Mar. 15, 2013

(65) Prior Publication Data

US 2013/0248290 A1 Sep. 26, 2013

(30) Foreign Application Priority Data

Mar. 21, 2012 (DE) ..... 20 2012 101 000 U

(51) Int. Cl.

| | |
|---|---|
| ***E04G 7/02*** | (2006.01) |
| ***E04G 5/08*** | (2006.01) |
| ***E04G 1/15*** | (2006.01) |
| ***E04G 7/28*** | (2006.01) |

(52) U.S. Cl.

CPC ..... *E04G 7/02* (2013.01); *E04G 1/152* (2013.01); *E04G 5/08* (2013.01); *E04G 7/28* (2013.01)

(58) Field of Classification Search

CPC ..... E04G 7/28; E04G 7/02; E04G 7/26; E04G 5/08; E04G 1/15; E04G 1/152

USPC ..... 182/112, 130, 222

See application file for complete search history.

(56) References Cited

U.S. PATENT DOCUMENTS

2007/0075198 A1 4/2007 Foser

FOREIGN PATENT DOCUMENTS

| | | |
|---|---|---|
| CA | 2 158 199 | 3/1997 |
| DE | 27 54 226 | 6/1979 |
| DE | 29 16 826 | 11/1980 |
| DE | 79 12 134 | 4/1992 |
| DE | 198 58 969 | 6/2000 |
| DE | 198 58 970 | 6/2000 |
| DE | 203 18 090 | 4/2004 |
| DE | 102 54 033 | 6/2004 |
| DE | 20 2004 021 196 | 3/2007 |
| DE | 20 2008 003 126 | 7/2008 |
| DE | 20 2011 002 618 | 5/2012 |

(Continued)

OTHER PUBLICATIONS

Australian Examination Report in Australian Application No. 2013201665, dated Jul. 21, 2014.

(Continued)

*Primary Examiner* — Katherine Mitchell
*Assistant Examiner* — Shiref Mekhaeil
(74) *Attorney, Agent, or Firm* — Collard & Roe, P.C.

(57) ABSTRACT

An overlap arrangement of at least two decking planks, for example for construction scaffolding, includes first and second decking planks. Each decking plank has a decking surface composed of sheet metal, which is provided with essentially round passage holes, which are delimited, in each instance, by a beaded and circumferential hole edge. The first decking plank and the second decking plank are braced, relative to one another, in releasable manner, using a locking screw composed of metal, to prevent displacement relative to one another in a displacement plane that runs parallel to their decking surfaces, and to prevent lift-off from one another.

13 Claims, 6 Drawing Sheets

(56) References Cited

FOREIGN PATENT DOCUMENTS

| | | | |
|---|---|---|---|
| EP | 1 767 791 | A1 | 3/2007 |
| GB | 2 012 851 | | 8/1979 |
| JP | H07-259219 | A | 10/1995 |
| WO | 89/12725 | A1 | 12/1989 |
| WO | WO 92/06259 | | 4/1992 |

OTHER PUBLICATIONS

European Search Report in 13153410.9, dated May 27, 2014, with English translation of relevant parts.

German Search Report dated Oct. 18, 2012 in German Patent Application No. 20 2012 101 000.3 with English translation of relevant parts.

European Examination Report in EP 13 153 410.9-1601, dated Feb. 17, 2016, with English translation of relevant parts.

OVERLAP ARRANGEMENT OF AT LEAST TWO DECKING PLANKS

CROSS REFERENCE TO RELATED APPLICATIONS

Applicant claims priority under 35 U.S.C. 119 of German Application No. 20 2012 101 000.3 filed Mar. 21, 2012, the disclosure of which is incorporated by reference.

BACKGROUND OF THE INVENTION

1. Field of the Invention

The invention relates to an overlap arrangement of at least two decking planks, particularly of at least two scaffold decks, for construction scaffolding, a work platform, a cantilever, a podium, or the like. More specifically, the overlap arrangement includes at least a first decking plank composed of metal, particularly of sheet steel, and a second decking plank composed of metal, particularly of sheet steel, of which each decking plank has a decking surface composed of sheet metal, which is provided with essentially round passage holes, preferably distributed essentially over the entire decking surface, whereby at least part of the passage holes, preferably a major portion of or essentially all the passage holes, are delimited, in each instance, by a beaded or domed, circumferential hole edge that spans an inside diameter that is always essentially or about the same size, in each instance, particularly whereby the hole edge of one part of these passage holes is beaded upward, and the hole edge of one part of these passage holes is beaded downward.

The second decking plank is disposed above the first decking plank, and overlaps the first decking plank in such a manner that the decking surface of the upper, second decking plank engages over the decking surface of the lower, first decking plank, at least in part. The first decking plank and the second decking plank are attached to one another, by means of an attachment pin, to prevent displacement relative to one another in a displacement plane that runs parallel to their decking surfaces, and secured to prevent lift-off from one another, in releasable manner.

The attachment pin has an attachment head and a pin shaft, which projects not only through a passage hole of the passage holes of the upper, second decking plank but also through a passage hole of the passage holes of the lower, first decking plank, whereby the attachment head engages around a hole edge of the particular passage hole of the passage holes of the upper, second decking plank and lies against this hole edge, through which hole the pin shaft of the attachment pin projects.

2. Description of the Related Art

When setting up scaffolding, particularly so-called system scaffolding, there can be set-up regions or placement regions, for example in the region of corners of buildings, in which no standardized attachment of scaffold decks is possible and/or in which gaps of wall regions must be bridged or where it is supposed to be possible to provide scaffolding elements that can be walked on. In such regions, for example, the scaffold decks are disposed to overlap with their end regions, and to lie at a slant one on top of the other, in order to be able to make a continuous decking surface available. In many cases, decking planks composed of metal are used as scaffold decks. Such decking planks have become known, for example, from DE 27 54 226 A, from DE 29 16 826 A, from DE 79 12 134 U1, from DE 198 58 969 A1, from DE 198 58 970 A1 or from DE 102 54 033 A1.

In practice, these decking planks are also referred to as steel decks, because they preferably consist of steel, particularly of sheet steel.

In earlier times, a wooden plank was frequently laid down as a bridging deck. Such wooden planks, however, have only a limited weather resistance, and their non-slip safety, particularly in rain, is not satisfactory. Also, such wooden planks cannot satisfy increased demands with regard to fire safety.

For this reason, it is desirable to be able to use bridging or supplemental decks composed of metal, particularly of steel and/or of aluminum. A particularly advantageous sheet-steel bridging decking plank has become known, for example, from DE 20 2004 021 196 U1. In practice, these decking planks are also referred to as steel planks, because they preferably consist of steel, particularly of sheet steel.

Such bridging decks or supplemental decks must be secured, for safety reasons, to prevent lift-off and lateral displacement. For this purpose, for example, one could use a screw that has a screw head and a threaded shaft, the threaded shaft of which could be inserted, for attachment assembly, through recesses of the scaffolding decks to be secured, which lie one on top of the other at least in partial regions, from above or from below. Subsequently, a nut could be screwed into the threaded shaft and tightened by means of a tool, in order to be able to achieve sufficient security to prevent lateral displacement and lift-off of the bridging deck or supplemental deck, in each instance, relative to at least one second scaffold deck firmly connected with the scaffolding. Assembly and disassembly using such a screw with a locking nut would be comparatively complicated, and acute risk of falling would exist when inserting the screw through from below or when screwing the locking nut, from below, onto the screw inserted through from above. In every case, the deck underside would have to be accessible.

A cylindrical pin in combination with a locking cotter pin could also be used as a connection means for securing a bridging deck or supplemental deck to a scaffold deck fixed in place on a scaffolding; this cotter pin is inserted into a transverse hole of the locking pin after the latter has been inserted through the holes of the scaffold decks to be connected. Such a connection would not be free of play, however, so that the bridging deck or supplemental deck could be moved, relative to the scaffold deck that is fixed in place on the scaffolding, both horizontally and vertically, and this arrangement would represent a safety risk. Here, too, the deck underside would have to be accessible in every case.

The use of self-locking pins would also be possible, but this method of connection would also have the disadvantage that it would not be possible without play. Furthermore, disassembly would be complicated.

Finally, connections between two scaffold decks using special clamps composed of metal have become known according to DE 20 2008 003 126 U1. Assembly and disassembly, however, are complicated and not easy to handle. Furthermore, here, too, no connection free of play is possible, and only restricted load-bearing capacity can be achieved.

With the goal of making available an attachment pin for securing at least two scaffold decks to prevent displacement relative to one another, which pin makes possible simple and fast assembly and disassembly, at increased work safety, from above, by hand, and without tools, and which guarantees security against lift-off, in the assembled state, it was proposed, according to DE 203 18 090 U1, that the pin shaft has an elastic and flexible element for engaging behind the recess edge, which element can be inserted through, with elastic deformation, at least at the recess edge of the recess of a first scaffold deck, manually, through the recesses of the scaffold decks to be attached to one another, and which, in the installed state, engages behind the recess edge of the recess of the first scaffold deck.

Such an attachment pin can be installed and removed without tools. Also, advantageous possibilities for balancing out tolerance of dimensions of the recesses of the scaffold decks and/or for balancing out different distances of the recess edges of the recesses of the scaffold decks to be secured relative to one another, possibly also caused by unevenness of the scaffold decks and/or their decking surfaces, can be created with attachment pins structured in this manner. Furthermore, such attachment pins can be produced, in simple and cost-advantageous manner, with robustness that satisfies the rough practical conditions in scaffolding construction, and fulfill their function and can be reliably used even when the scaffold decks are dirty. When using such attachment pins, however, it is not possible to achieve play-free connections. Furthermore, these attachment pins can be used only once, at least when connections are required that satisfy the greatest possible safety requirements in scaffolding construction. Finally, the load-carrying capacity of these attachment pins, which consist of plastic, is limited.

SUMMARY OF THE INVENTION

It is therefore an object of the invention to make available an overlap arrangement of the type indicated initially, which satisfies the greatest safety requirements in scaffolding construction, in which a play-free connection of at least two decking planks to be secured is possible, without the risk of lateral slipping and/or vertical lift-off, and with which installation and removal from above is possible, easily and without problems, and with which installation and removal is possible, easily and without problems, even if no access from below is possible on the underside of the lower decking plank, as is the case, for example, for single-layer ceiling scaffoldings.

These and other objects are accomplished by an overlap arrangement according to the invention wherein the attachment pin is a locking screw composed of metal, and wherein the attachment head is a screw head of the locking screw, which is screwed directly at least into the said passage hole of the lower, first decking plank, essentially without or without any plastic deformation and essentially without or without any elastic widening of the hole edge of this passage hole, with its preferably not self-tapping thread, and wherein or so that the second decking plank and the first decking plank are braced against one another with force fit and shape fit, preferably without play, using the locking screw that lies against a hole edge or the hole edge of the said passage hole of the upper, second decking plank.

It therefore lies at the core of the invention that the geometry of the thread of the locking screw is structured to be coordinated with the geometry of the beaded or domed hole edges of the decking planks to be secured, in such a manner that while the locking screw is screwed into the passage hole or the passage holes, essentially no or no plastic deformation comes about and also, essentially no or no elastic widening of the hole edge of the passage holes, in each instance, comes about, and that the decking planks to be secured can be braced or are braced relative to one another using the screwed-in locking screw, with force fit and shape fit. It is understood that during the bracing process, slight elastic deformations or widenings all the way to slight plastic deformations can occur in the hole edge region, by means of screwing or tightening the locking screw, as a function of the torque or tightening torque applied in this connection. These slight deformations, to the extent that they occur at all, however, do not impair the function or the quality of the shape-fit and force-fit connection. In other words they are not relevant for reliable use in practice over an extended period of time.

According to a preferred exemplary embodiment, it can be provided that the locking screw is screwed, with its thread, not only directly into the said passage hole of the upper, second decking plank, but also directly into the said passage hole of the lower, first decking plank, essentially without or without any plastic deformation and essentially without or without any elastic widening of these two passage holes. In this way, it is possible to achieve an even better connection, with greater load-bearing capacity, as well as secure locking. For this purpose, the thread of the locking screw can be configured to be correspondingly long or, if applicable, also only in the region of the passage hole, in each instance. In this way, such locking screws can also be used for other bridging applications, for example for securely screwing a separate flooring surface made of metal, having corresponding passage holes, particularly a separate flooring sheet, to one or more of the decking planks, for closing gaps between two overlapping decking planks.

Using the invention, it is possible to brace the first decking plank and the second decking plank, relative to one another, using only the locking screw. In other words, the first and second decking planks are braced relative to one another without any other ancillary attachment means and/or without using a nut screwed onto the locking screw. In this way, the first and second decking planks are braced to prevent lift-off from one another and lateral displacement relative to one another, using the locking screw to provide a force fit and a shape fit. Accordingly, it can preferentially be provided that the first decking plank and the second decking plank are braced relative to one another only using the locking screw, in other words free of any other ancillary attachment means and/or without using a nut screwed onto the locking screw, secured to prevent lift-off from one another and lateral displacement relative to one another, with force fit and shape fit.

According to a preferred further development, the passage holes through which the locking screw projects or into which the locking screw is screwed with its thread span an inside diameter that has essentially or about the same size. In this way, the locking screw can be structured continuously with the same thread, particularly so that no differently great thread diameters have to be present on one and the same locking screw. Furthermore, it then does not matter which of the decking planks forms the lower decking plank and which of the decking planks forms the upper decking plank, so that corresponding handling and installation advantages occur.

According to a preferred exemplary embodiment, the thread has an outside thread diameter that is slightly, namely only by about 1.5 to about 5.0 percent greater than the inside diameter of the particular passage hole into which the locking screw is screwed with its thread, or only by about 1.5 to about 5.0 percent greater than the inside diameter of those passage holes into which the locking screw is screwed with its thread. In this way, for one thing, a secure shape-fit and force-fit connection is made possible, and for another, the locking screw can be screwed in and unscrewed without jamming.

According to a very particularly preferred exemplary embodiment, the outside thread diameter of the thread is greater by about 3.0 percent than the inside diameter of the passage hole into which the locking screw is screwed with its thread, or greater by about 3.0 percent than the inside diameter of the particular passage holes into which the locking screw is screwed with its thread. In this way, a further improvement in the sense of the above advantages can be achieved.

According to a further development, the inside diameter of the passage hole amounts to about 13.0 mm to about 14.0 mm, particularly about 13.2 to about 13.6 mm, and the outside thread diameter amounts to about 13.7 mm to about 14.3 mm, particularly about 14.0 mm. Such a diameter pairing has proven to be particularly advantageous in the above sense when using the decking planks of the patent proprietor, which have successfully proven themselves in practice.

According to a preferred exemplary embodiment, the thread has a thread pitch that amounts to about 0.25 to about 0.35 times, particularly about 0.3 times the inside diameter of the passage hole into which the locking screw is screwed, or the inside diameter, in each instance, of the particular passage holes into which the locking screw is screwed. In this way, a further improvement in the sense of the above advantages can be achieved.

According to a preferred further development, the beaded hole edges are delimited circumferentially, viewed in a cross-section that contains a passage hole axis, in each instance, with an inside radius, and the thread has a thread pitch that approximately corresponds to the inside radius or is equal to or slightly greater or slightly less than the inside radius. In this way, a further improvement in the sense of the above advantages can be achieved.

According to a very particularly preferred exemplary embodiment, the thread has a thread pitch of about 3.5 mm to about 5.0 mm, particularly of about 4.0 mm. In this way, in combination with the decking planks of the patent proprietor that have proven themselves in practice, a very particularly secure connection can be achieved, whereby the locking screw can be screwed into the passage hole of the decking plank or into the passage holes of the decking plank particularly easily and without jamming, and consequently can be screwed onto and braced with the decking plank or with the decking planks.

In complicated experiments, it has been shown that the thread can preferably be structured in such a manner that the thread has a flank angle that amounts to about 35 degrees to about 50 degrees, particularly about 42 degrees.

Preferably, the thread can have a core diameter that amounts to about 9 mm to about 11 mm, particularly about 10 mm. In this way, the locking screw in particularly simple and easy or jam-free manner can be screwed in, and can also be easily tightened, i.e. without any great expenditure of force, for bracing the decking planks to be secured.

According to a preferred embodiment, the thread is a V-shaped thread or a trapezoid thread. In this way, a further improvement in the sense of the above advantages can be achieved.

According to a further development, the thread has a thread core that spans a or the core diameter, which core has a width between adjacent thread flanks, viewed in the direction of a longitudinal screw axis of the locking screw, which amounts to about 1.5 to about 2.5 mm, preferably about 2.0 mm. In this way, a further improvement in the sense of the above advantages can be achieved.

In a preferred further development, the hole edges of the passage holes are beaded up all the way to a hole edge height above or below a surface of the sheet metal, and wherein the screw head of the locking screw has a head height that corresponds approximately to the hole edge height of the hole edges, or that is equal to or less than the hole edge height of the hole edges. In this way, particularly if the locking screw is introduced or screwed into a passage hole with its thread end or insertion end, in the direction of the beading of a passage hole provided with hole edges that are beaded downward, and if the hole edges of adjacent passage holes are beaded upward, the screw head can be accommodated in such a manner that a tripping hazard is avoided or prevented.

According to a further development, the head height of the screw head of the locking screw amounts to about 3.0 mm to about 5.0 mm, particularly about 3.5 to about 4.0 mm. In this way, a further improvement in the sense of the above advantages can be achieved.

According to a preferred embodiment variant, the screw head has a slit that is U-shaped in cross-section in its head side facing away from the screw-in end of the locking screw; this slit is preferably continuous over the entire head width and can be used to screw in, tighten, and loosen the locking screw again, by means of a screwdriver or similar tool.

According to an advantageous embodiment, the thread ends at a distance from a or the screw-in end of the locking screw, so that the locking screw has a thread-free insertion end for insertion of the locking screw, in the direction of its longitudinal screw axis, into a passage hole of the passage holes, preferably whereby the thread-free insertion end can be configured in the form of a circular cylinder having an outside diameter, particularly one that can correspond to the core diameter of the thread of the locking screw or that can be smaller than that of the core diameter. This arrangement facilitates introduction or screwing in of the locking screw into the passage hole, or the respective passage hole.

The invention also relates to construction scaffolding, a work platform, a cantilever or a podium, having an overlap arrangement according to the invention.

The construction scaffolding, the work platform, the cantilever or the podium can be structured or configured in such a manner that the first decking plank extends at one height and that a third decking plank extends at approximately the same height, at a horizontal distance from the first decking plank, whereby the second decking plank is provided as a bridging decking plank for bridging a space between the first decking plank and the third decking plank, so that the decking surface of the bridging decking plank engages over not only the decking surface of the first decking plank but also the decking surface of the third decking plank, and whereby the bridging decking plank forms an overlap arrangement not only with the first decking plank but also with the third decking plank, in each instance, so that the bridging decking plank is braced together not only with the first decking plank, using the locking screw, with force fit and shape fit, preferably without play, but also with the third decking plank, using a corresponding or same locking screw, with force fit and shape fit, preferably without play.

BRIEF DESCRIPTION OF THE DRAWINGS

Further characteristics, advantages and aspects of the invention can be derived from the following description part, in which a preferred exemplary embodiment of the invention is described using the figures.

It is understood that a person skilled in the art can combine the above and also the following characteristics and measures, within the scope of implementability, individually or in groups, in any desired manner.

In the drawings:

FIG. 1 is a three-dimensional representation of a system scaffolding having two overlap arrangements;

FIG. 2 is a three-dimensional representation of an overlap arrangement having two decking planks in the form of scaffold decks;

FIG. 3 is a three-dimensional representation of a cascade overlap arrangement of more than two decking planks that lie one on top of the other, of which immediately adjacent decking planks, in each instance, are braced relative to one another using a locking screw according to the invention, in each instance, secured to prevent lateral displacement and to prevent lift-off;

FIG. 4 shows another overlap arrangement having two overlapping decking planks, in cross-section that contains the longitudinal axis of a locking screw according to the invention and is configured perpendicular to the longitudinal axes of the decking planks;

FIG. 5 is a greatly enlarged detail of the overlap arrangement according to FIG. 4 in the region of the screw-in end of the locking screw;

FIG. 6 is a three-dimensional representation of a locking screw according to the invention;

FIG. 7 is a side view of the locking screw;

FIG. 8 is a side view of the locking screw rotated by 90 degrees as compared with the side view according to FIG. 7;

FIG. 9 is a top view of the screw head of the locking screw according to FIG. 8;

FIG. 10 is a longitudinal section of the locking screw along the section lines 10-10 in FIG. 8;

FIG. 11 is a greatly enlarged detail of the longitudinal section of the locking screw in the region of the section of the locking screw indicated with a circle in FIG. 10.

DETAILED DESCRIPTION OF PREFERRED EMBODIMENTS

Figure 1:
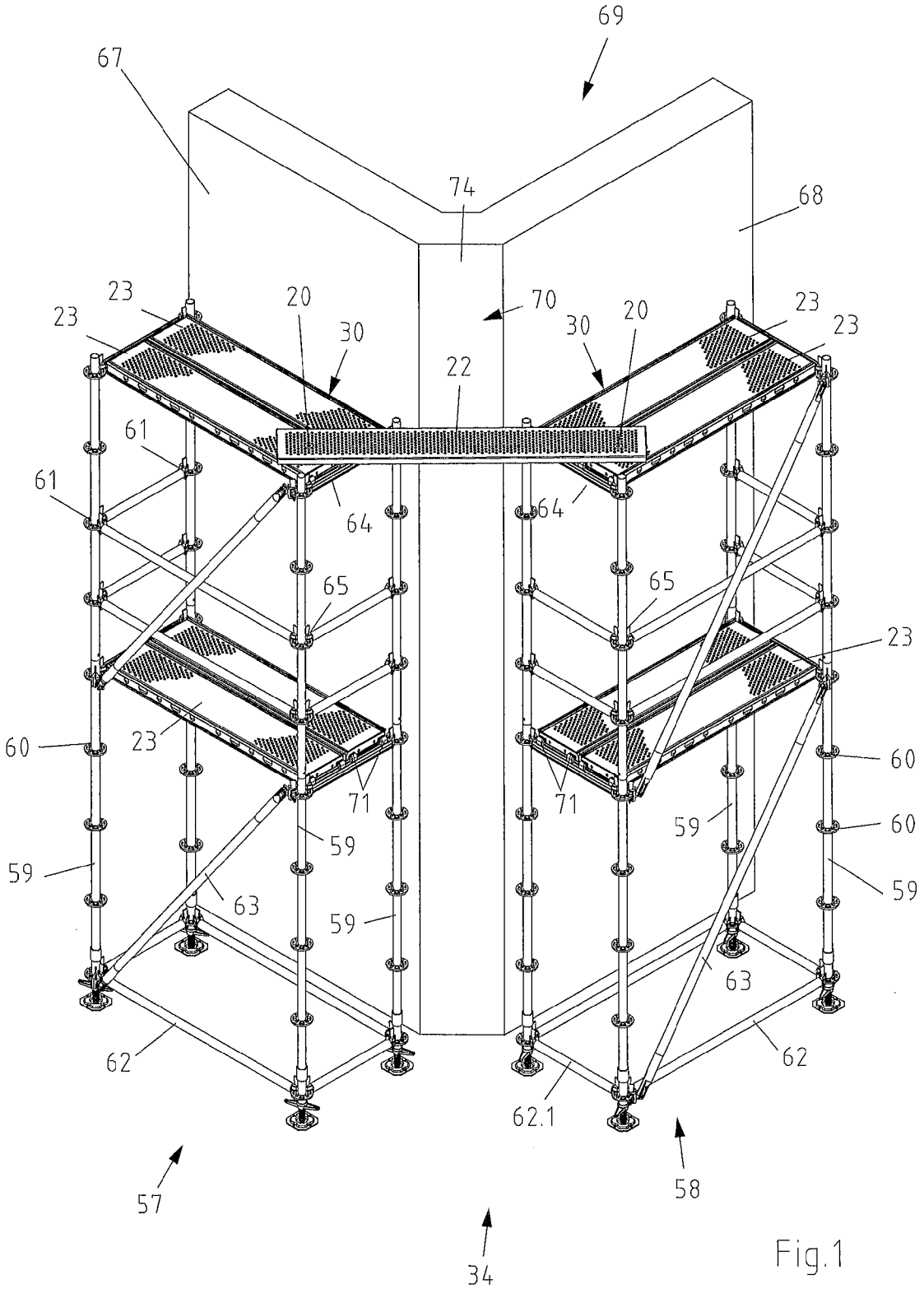

Referring now in detail to the drawings, FIG. 1 shows a system scaffolding 34 in a setup situation with two scaffolding parts 57 and 58. The two scaffolding parts 57, 58 are set up, in each instance, along and adjacent to a building wall 69 of a building. The building wall comprises two wall parts 67, 68 that stand perpendicular to one another, and a wall part 74 formed between them. The wall part 74 forms a building corner transition with a building corner 70 structured at a slant of 45 degrees relative to the side building walls or wall parts 67, 68.

The system scaffolding 34 is composed of posts 59 that carry known, essentially flat perforated disks 60 spaced apart from one another at a distance that corresponds to the raster dimension of the scaffolding system. Between the posts 59, horizontal rods 62, 62.1, diagonal rods 63, and horizontal support bars 64 can be attached to the perforated disks 60, using wedge heads 61 that are also called connection or connecting heads. For this purpose, wedges 65 penetrate the perforated disks 60 and the wedge heads 61. The perforated disks 60 preferably have eight perforations, which are each disposed at an angle of about 45 degrees relative to one another, through which the wedges 65 extend in the assembled, wedged state, and impart a specific orientation to the connecting heads 61 clamped in place on them, with scaffolding elements that are attached to them, preferably by means of welding.

The horizontal support bars 64 preferably have a profile that is open toward the top and U-shaped in cross-section, which profile is provided with profile crosspieces that project upward. Suspension aids 71, for example in the form of suspension claws, can be laid onto the upper contact edges of the profile crosspieces, which aids can preferably be attached to face sides of the scaffold decks 23 that have work surfaces or decking surfaces 25.

In the exemplary embodiment shown, two scaffold decks 23, in each instance, are disposed next to one another with opposite longitudinal face sides. It is understood, however, that the width of the scaffolding part 57, 58, in each instance, or the width of the horizontal bars, can be selected in accordance with the requirements, in each instance, also in such a manner that it can be structured to be adapted to only one scaffold deck 23 or also to more than two scaffold decks that lie next to one another. In the aforementioned manner, a stable system scaffolding 34 that meets the practical requirements in particular manner can be constructed. It is understood, however, that the invention can also be advantageously used in connection with other system scaffoldings or other scaffoldings.

In the event that one of the two scaffolding parts 57 or 58 were to be set up in such a manner that it overlaps the other scaffolding part 58 or 57 on the face side, a gap would occur between the slanted wall part 74 of the corner 70 and one of the scaffolding parts 57 or 58, which gap would not be sufficiently secured. Furthermore, the scaffolding part 57 or 58 in question would then have a comparatively great distance from the slanted wall part 74 of the corner 70, which would make work on this wall part 74 impossible or possible only under difficult conditions.

For this reason, a further scaffold deck 22 is provided as a bridging deck or supplemental deck, which is also referred to as a second or upper scaffold deck. This scaffold deck 22 is disposed, in the exemplary embodiment, approximately parallel to the slanted wall part 74 of the corner 70 and adjacent to it. In this connection, the scaffold deck 22, in partial regions, here with one of its two end regions, in each instance, lies on the surface of a scaffold deck 23, in each instance, of the scaffold decks 23, 23, disposed at a horizontal distance from one another, at about the same height, and specifically, here, in the uppermost level of the scaffolding parts 57 and 58.

The scaffold decks 22 and 23 consist, in each instance, of sheet steel. At the longitudinal edges of the scaffold decks 22, 23, longitudinal edge rails 86.1, 86.2; 90.1, 90.2, formed by means of bending, are provided, in each instance. The longitudinal edge rails 86.1, 86.2; 90.1, 90.2 have a lower rail or reinforcement profile 88.1, 88.2; 92.1, 92.2, in each instance, formed by means of bending, extending in the longitudinal direction. The reinforcement profile 88.1, 88.2; 92.1, 92.2, in each instance, forms a lower rail, in each instance. The reinforcement profile of the lower rail 88.1, 88.2; 92.1, 92.2 extends, in each instance, essentially over the entire length of the scaffold deck 22, 23, in each instance, parallel to its longitudinal axis. The two edge rails 90.1, 90.2 of the second or upper scaffold deck 22, in other words here the bridging deck or supplemental deck 22 (also referred to as the steel plank 22) have a height 91 that amounts to about 45 mm to about 46 mm, for example. The two edge rails 86.1, 86.2 of the first or lower scaffold deck 23 (also referred to as the steel plank 23) have a greater height 87, as compared with the height 91 of the edge rails 90.1, 90.2 of the second or upper scaffold deck 22, which height amounts to about 76 mm to about 77 mm, for example. See FIG. 4. The upper edge of the hole edges 28.1 or 32.1 of the hole edges 27.1 or 32.1, which is beaded or domed upward, is disposed slightly below the upper edge of the edge rail 90.1, 90.2 or 86.1, 86.2, in each instance, for example by about 0.5 mm below.

The scaffold decks 22, 23, in each instance, have end profiles 89, 93 composed of metal, firmly connected with the decking surface 24, 25 and firmly connected with the longitudinal edge rails 86.1, 86.2; 90.1, 90.2, on their two face sides that face away from one another. The end profiles 89, 93 extend essentially over the entire width of the scaffold deck 22, 23, in each instance. The end profiles 89, 93, preferably configured as U profiles, have a height, in each instance, that corresponds to the clear width between the underside of the sheet metal 84 that forms the decking surface 24, 25, and the reinforcement profile or lower rail 88.1, 88.2; 92.1, 92.2, in each instance. The end profiles 89, 93 and the longitudinal edge rails 86.1, 86.2; 90.1, 90.2, in each instance, form a frame composed of metal. On the scaffold deck 23, suspension aids 71 in the form of suspension hooks or suspension claws composed of metal are attached to the end profile 89, in each instance, preferably by means of welding, which aids are disposed at a transverse distance from one another. A scaffold deck 23 equipped in this manner is also referred to, in practice, as a steel plank. In contrast to this scaffold deck 23, the scaffold deck 22 used as a bridging scaffold deck or supplemental scaffold deck is not equipped with any special suspension aids. Accordingly, no suspension claws or similar suspension aids are provided on its end profiles 93. Such a scaffold deck 22 is also referred to as a steel plank in practice.

The scaffold decks 22, 23, in each instance, have a decking surface 24, 25 composed of sheet metal 84, preferably composed of sheet steel, having a thickness 85. Sheet metal 84 is essentially distributed over the entire decking surface 24, 25, and is provided with essentially circular passage holes 27, 31 having hole edges 28, 32 with inside contours 38, 37 and radii 54, 55. The passage holes 27, 31 are therefore configured as circular holes 39, 40. The passage holes 27, 31 form perforations of the decking surfaces 24, 25 of the scaffold decks 22, 23, in each instance. Each scaffold deck 22, 23 has a plurality of passage holes 27, 31. The passage holes 27, 31, in each instance, have a passage hole axis 52 and span an inside diameter 36 that has essentially the same or about the same size, and are delimited, in each instance, by a beaded or domed, circumferential hole edge 28; 28.1, 28.2; 32; 32.1, 32.2. The inside diameter 36 amounts to about 13.6 mm in the preferred exemplary embodiments shown, but can also be smaller by up to about 0.4 mm. The hole edge 28.1; 32.1 of part of these passage holes 27.1; 31.1 is beaded or domed upward, and the hole edge 28.2; 32.2 of part of these passage holes 27.2; 31.2 is beaded or domed downward. In other words, a plurality of the passage holes 27.1, 31.1 is provided with hole edges 28.1, 32.1 that are beaded or domed upward from the decking surface 24, 25, in each instance, and a further plurality of the passage holes 27.2, 31.2 is provided with hole edges 28.2, 32.2 that are beaded or domed downward from the decking surface 24, 25, in each instance. In this connection, the passage holes 27.1, 31.1 having hole edges 28.1, 31.1 that are beaded or domed upward form anti-slip security, and the passage holes 27.2, 31.2 having hole edges 28.2, 32.2 that are beaded or domed downward form drain openings for fluids, such as rain water or paint and the like.

To secure the scaffold decks 22 shown in FIG. 1, which serve as a bridging deck or supplemental deck, relative to the two scaffold decks 23 that carry them, to prevent displacement in a horizontal displacement plane 21 or one that runs parallel to their decking surfaces 25 or laterally, the upper scaffold deck 22, in each instance, is attached to the scaffold deck 23 of the scaffolding parts 57 and 58, in each instance, here the deck that lies on the outside, in each instance, using a locking screw 20 according to the invention.

Figure 2:
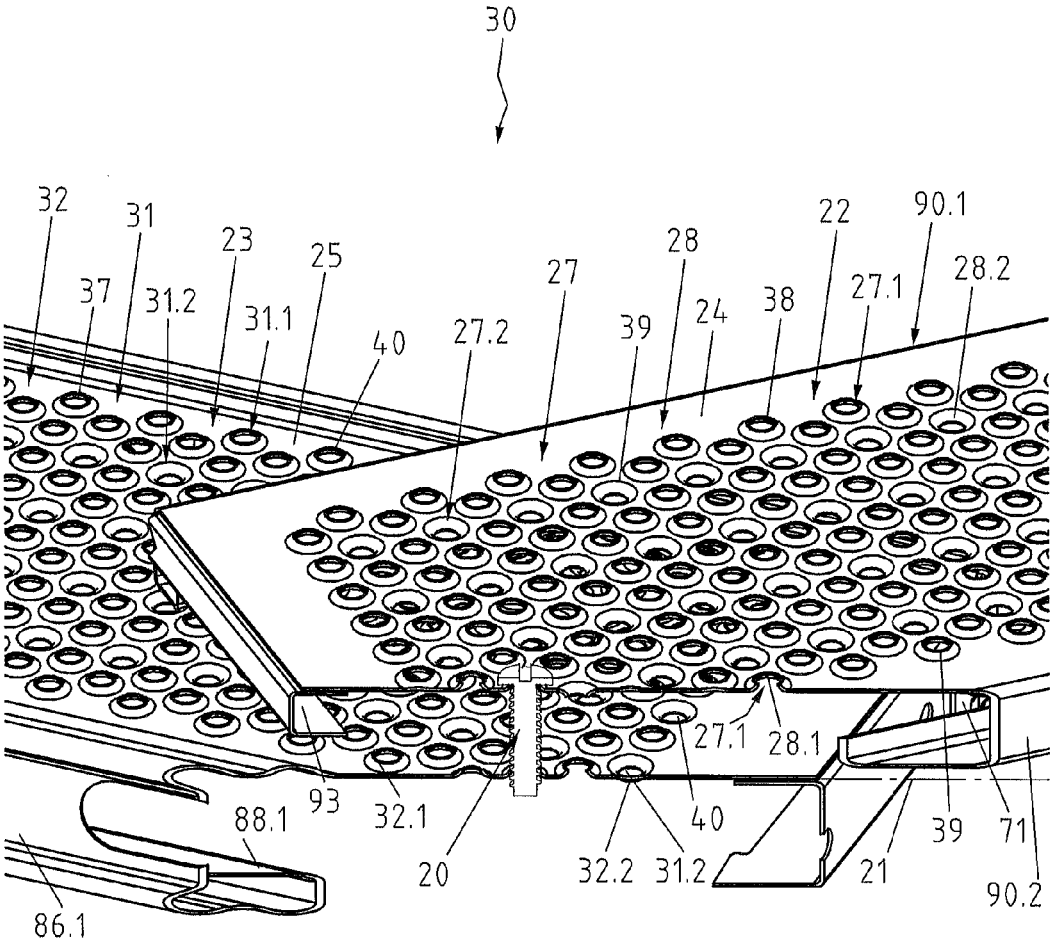

FIG. 2 shows an overlap arrangement 30 having two decking planks 22, 23 in the form of scaffold decks, for example in the region of the corner transition according to FIG. 1. In this connection, an upper decking plank 22 in the form of a bridging or supplemental scaffold deck, also referred to as a second decking plank, lies on the surface, structured as a decking surface 25 of a lower decking plank 23 in the form of a scaffold deck of a free-standing scaffolding, also referred to as a first decking plank 23, with one of its end regions, overlapping it. The lower or first scaffold deck 23 is attached to the support bars 64 by means of known attachment means 71, for example using the suspension hooks or suspension claws shown. The said second or upper decking plank 22 is braced with the first decking plank 23, using a locking screw 20 according to the invention, which is shown in longitudinal section here, which is screwed not only into a passage hole 27.2 of the second or upper decking plank 22 but also into a passage hole 31.1 of the first or lower decking plank 23, secured relative to the first decking plank 23 that carries it, to prevent lateral displacement in the displacement plane 21 and to prevent lift-off. In FIG. 2, it is therefore shown, using the example of two scaffold decks 22 and 23, how one of the bridging or supplemental scaffold decks 22 can be secured relative to one of the scaffold decks 23, using a locking screw 20, to prevent lateral displacement in the displacement plane 21, and to prevent lift-off in a direction perpendicular to the displacement plane 21, and away from the scaffold deck 23.

In this connection, the bridging or supplemental scaffold deck 22 lies on the surface of the lower scaffold deck 23 in one of its end regions, and at a slant to the scaffold deck 23, in its end region. The locking screw 20 projects through a passage hole 27.1 of the upper scaffold deck 22, which hole has hole edges 28.1 beaded or domed downward below the decking surface 24, while the locking screw 20 projects through a passage hole 31.2 of the lower scaffold deck 23, which has hole edges 32.1 beaded or domed upward above the decking surface 25 of this lower scaffold deck 23.

In this connection, the locking screw 20 is screwed not only directly into the passage hole 27.1 of the upper scaffold deck 22, but also directly into the passage hole 31.2 of the lower scaffold deck 23, specifically without plastic deformations, in each instance, and without elastic widening of the passage hole 27.1, 31.2, in each instance.

By means of the locking screw screwed into the passage holes 27.1, 31.2, the two scaffold decks 22 and 23 are braced against one another without play, as well as with force fit and shape fit, whereby they are secured, by means of the locking screw 20, to prevent displacement in the said displacement plane 21 and to prevent lift-off from one another.

It is understood that the locking screw 20 can also be guided through the passage holes 27, 31 in any other desired manner. For example, the locking screw 20 can project through a passage hole 27.2 of the upper scaffold deck 22, which hole has hole edges 28.2 that are beaded or domed upward above the decking surface 24, while the locking screw 20 can project through a passage hole 27.1 of the lower scaffold deck 23, which hole has hole edges 32.2 that are beaded or domed downward below the decking surface 25 of this scaffold deck 23. It is furthermore understood that the locking screw 20 can project, both in the case of the scaffold deck 22 and in the case of the scaffold deck 23, through their passage holes 27.2, 31.2 that have hole edges 28.2, 32.2 that are beaded or domed downward below the decking surfaces 24, 25, in each instance, or through their passage holes 27.1, 31.1 that have hole edges 28.1, 32.1 that are beaded or domed upward above the decking surfaces 24, 25, in each instance. In this manner, flexible securing of two scaffold decks 22, 23 relative to one another, at different attachment positions, can be implemented. This implementation is also supported, in the exemplary embodiment, by the plurality of passage holes 27, 31 disposed essentially over the entire decking surface 24, 25 of the scaffold deck 22, 23, in each instance, with the exception of edge regions, closely adjacent to one another at a small distance.

Figure 3:
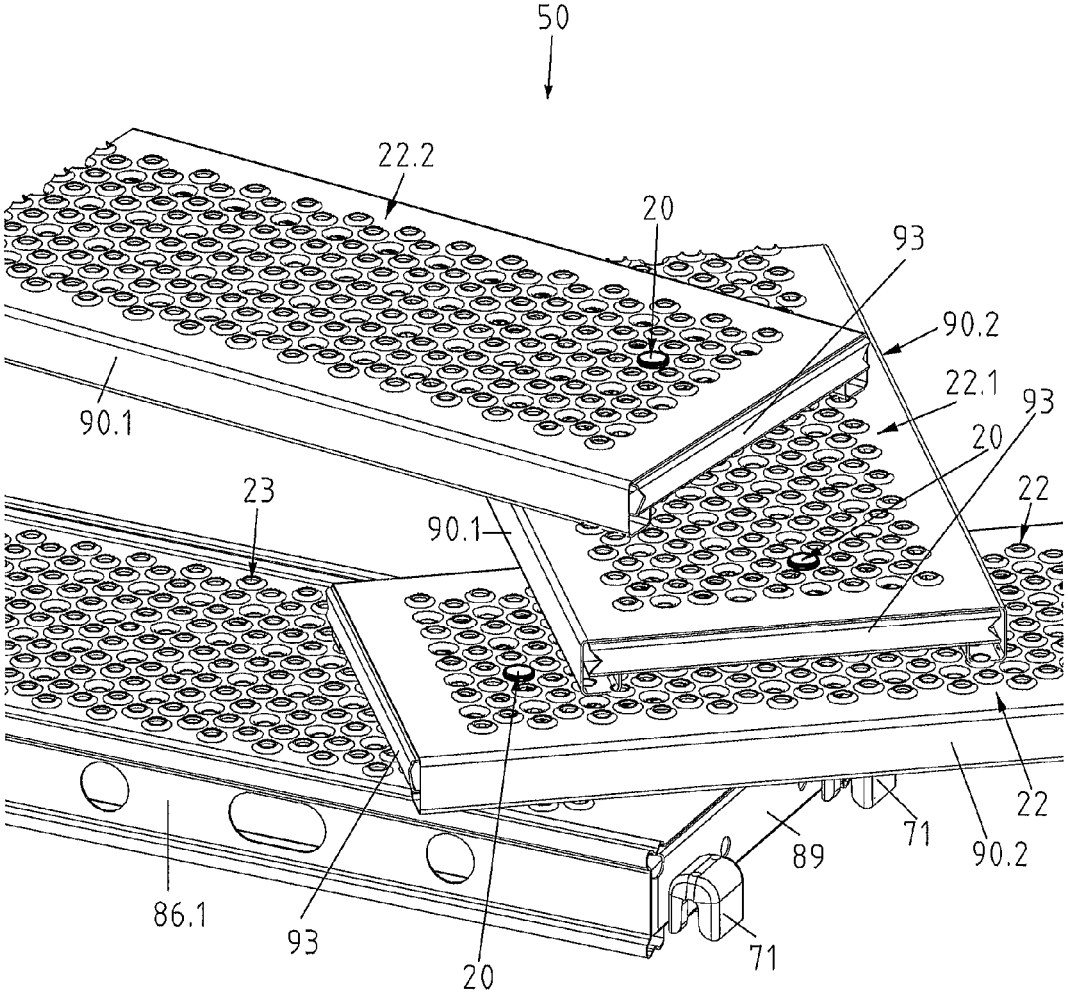

As is evident from FIG. 3, a plurality of more than two scaffold decks 22, 22.1, 22.2, which can serve as bridging or supplemental scaffold decks, in the form of a cascade overlap arrangement 50, can be secured relative to one another and relative to at least one scaffold deck 23, using locking screws 20 according to the invention. In this connection, two of the scaffold decks 22.2, 23; 22.1, 22, in each instance, can be secured relative to one another by means of at least one locking screw 20, in each instance, to prevent lateral displacement and lift-off.

Figure 4:
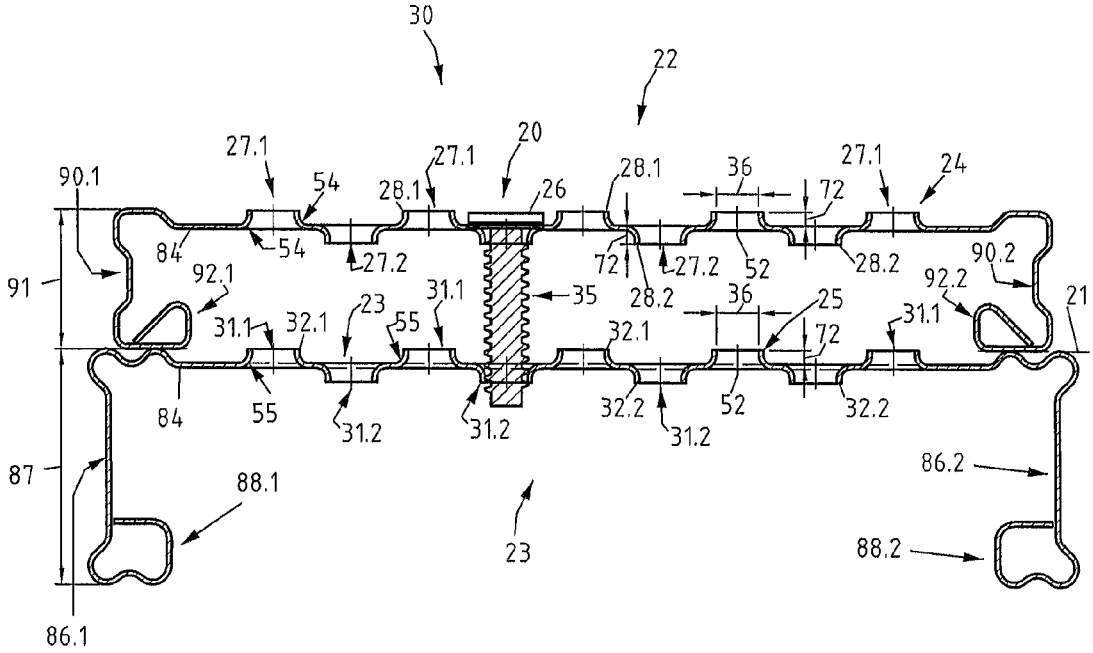

In the exemplary embodiment of an overlap arrangement 30 shown in FIG. 4, the locking screw 20 is screwed not only directly into the passage hole 27.2 of the upper scaffold deck 22 that is circumferentially delimited by a hole edge 28.2 that is beaded or domed downward, but also directly into the passage hole 31.2 of the lower scaffold deck 23 that is also circumferentially delimited by a hole edge 32.2 that is also beaded or domed downward, specifically without any plastic deformations, in each instance, and without elastic widening of the passage hole 27.2, 31.2, in each instance. The attachment head or screw head 26 of the locking screw 20 engages over the particular passage hole 27.2 of the upper scaffold deck 22 into which the locking screw 20 is screwed, and the said screw head 26 lies against the surface between two adjacent hole edges 28.1, 28.1 of passage holes 27.1, 27.1 of the sheet metal 84, which are beaded or domed upward, in each instance.

The screw head 26 has a head height 78 that corresponds to the hole edge height 72 of the hole edges 28, 32 that are beaded or domed upward, above the said surface of the sheet metal 84, so that no tripping hazard can occur. The hole edge height 72 amounts, for example, to 3.5 to 4.0 mm. By means of the locking screw 20 screwed into the passage holes 27.2, 31.2, the two scaffold decks 22 and 23 are braced against one another without play, and with force fit and shape fit, whereby they are secured to prevent displacement in the displacement plane 21 and to prevent lift-off from one another, by means of the locking screw 20.

Figure 5:
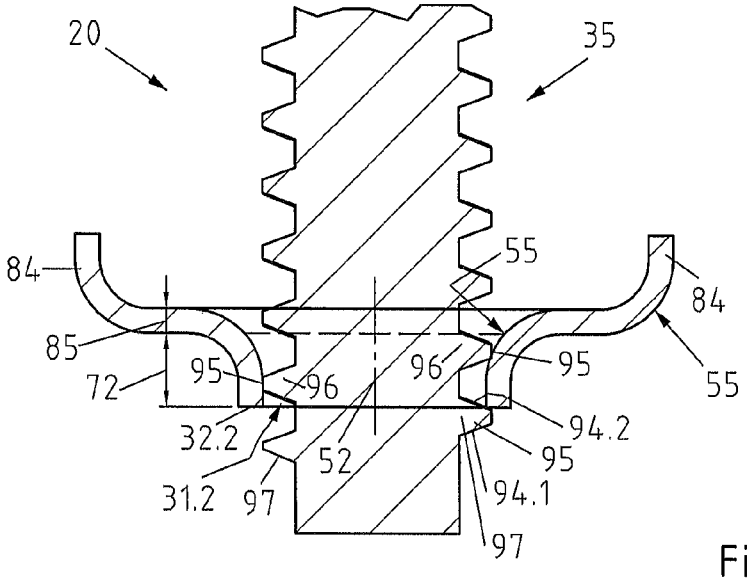
Figure 7:
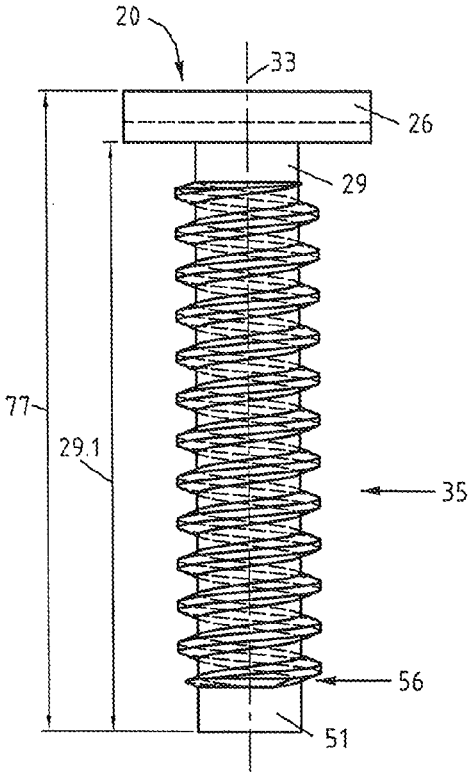

As can be seen well in the greatly enlarged representation in FIG. 5, here the last thread channel 97 of the locking screw 20 screwed into the passage hole 31.2 of the lower scaffold deck 23 engages, with the thread flank 94.2 of the thread 35, into the lower ring face edge of the hole edge 32.2 of this passage hole 31.2, which is beaded or domed downward, so that in connection with the screw head 26 that engages over the passage hole 27.1 of the upper scaffold deck 22 laterally, a force-fit and shape-fit connection and bracing of the two scaffold decks 22 and 23 with one another can be achieved or has been achieved. As can also be seen well in FIG. 5, here the next-to-last thread channel 96 of the threaded screw lies against the hole edge 32.2 that is beaded or domed upward, with the thread tip of the thread 35, against the inside surface that is circumferentially rounded with an inside radius 55. The geometry of the thread 35 of the locking screw 20 is structured to be adapted to the geometry of the hole edges that are beaded or domed upward, in such a manner that no elastic or plastic deformation of the hole edge of these passage holes can occur while the locking screw 20 is being screwed into the passage holes.

Figure 8:
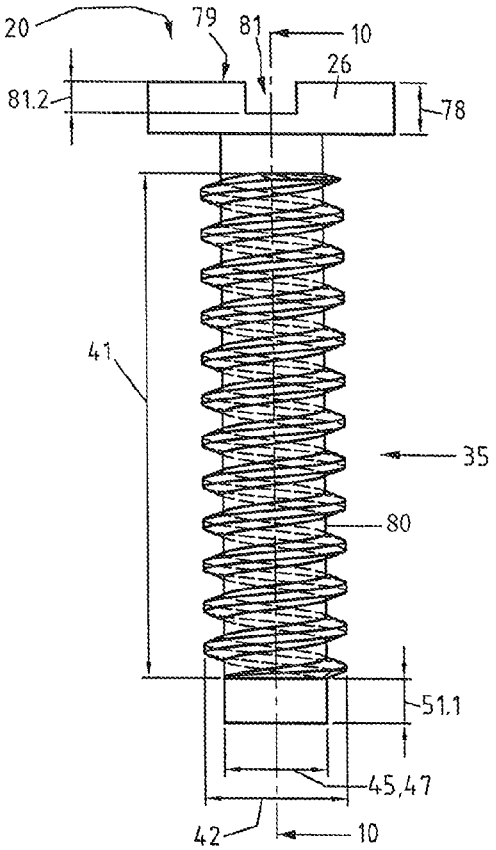
Figure 6:
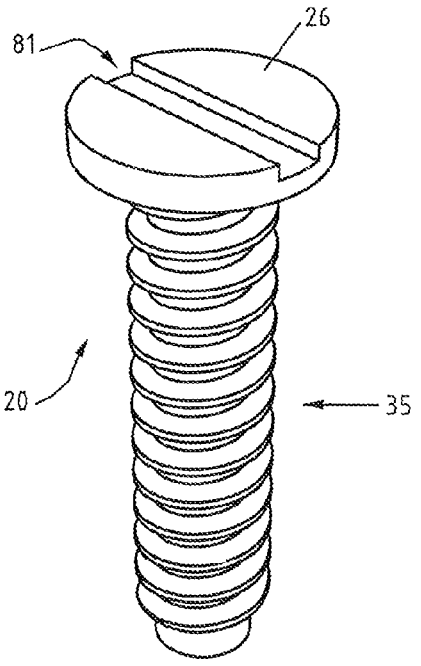
Figure 9:
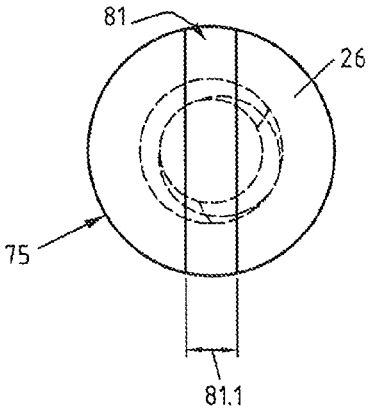
Figure 10:
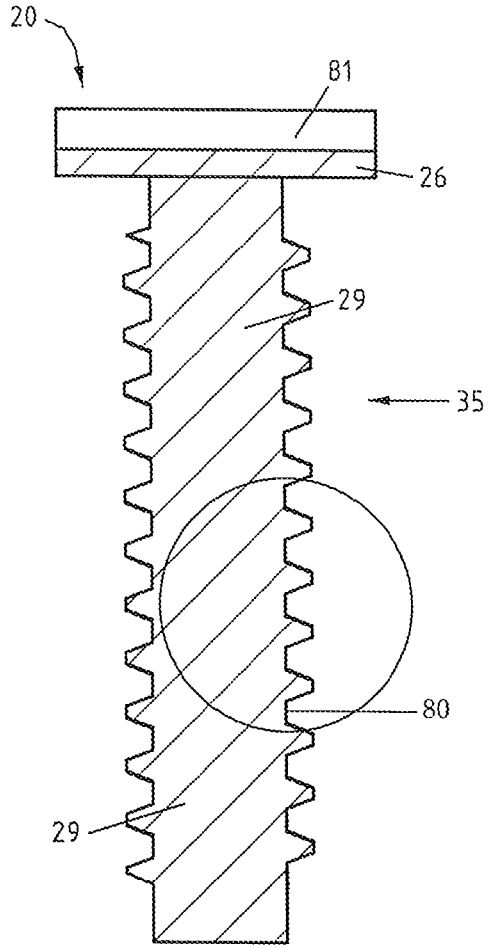
Figure 11:
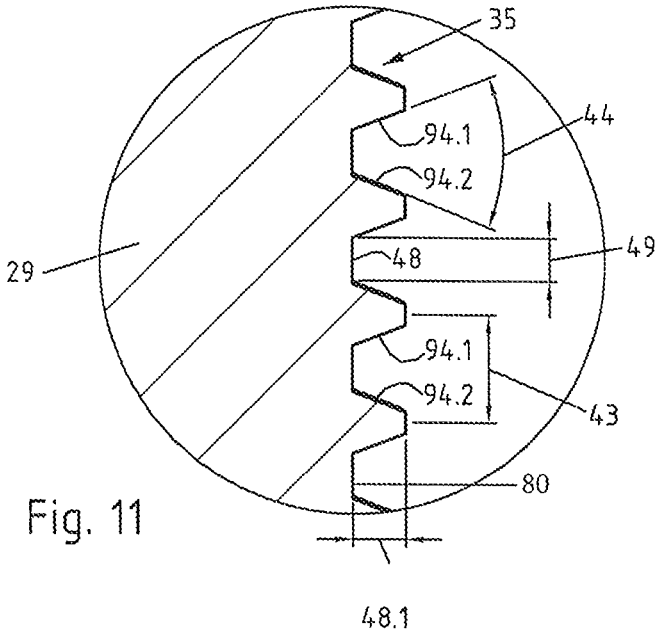

The locking screw 20 according to the invention is shown separately in FIGS. 6 to 11. The locking screw 20 consists of metal, preferably of steel. The locking screw 20 has, as essential elements, a pin shaft or screw shaft 29 having a thread 35, and a screw head 26. The screw shaft 29 extends, in a longitudinal direction, parallel to a longitudinal axis 33 of the locking screw 20. The screw head 26 is disposed at one end of the locking screw 20, and extends perpendicular to the longitudinal axis 33 or to the screw shaft 29, radially outward, all the way beyond the outside diameter 42 of the thread 35. The screw head 26 is structured as a flat head with a circular cylinder. It has a head diameter or outside diameter 75. The head diameter or outside diameter amounts, for example, to about 3.5 to about 4.0 mm. The screw head 26 is provided, at its head side 79 facing away from the screw-in end 56 or the insertion end 51 of the screw shaft 29, with a slit 81 that is open to the outside and U-shaped in cross-section. The slit 81 has a slit width 81.1 (FIG. 9) and a slit height 81.2 (FIG. 8). The slit width 81.1 amounts, for example, to about 5.0 mm, and the slit height 81.2 amounts, for example, to about 2.0 to about 2.5 mm.

The length 77 of the locking screw 20 amounts, for example, to about 60 mm to about 62 mm. The length 29.1 of the screw shaft 29 amounts, for example, to about 57 mm. The thread 35 of the locking screw 20 extends, in the longitudinal direction, not over the entire length 29.1 of the screw shaft 29, but rather over only a partial length or thread length 41, for example of about 49 mm. The thread 35 ends, viewed in the direction of the screw head 26, at a distance before the screw head 26, and ends, viewed in the opposite direction, at a distance 51.1 before the other end of the screw shaft 29. This distance 51.1 amounts, for example, to about 4.0 mm. In this manner, an insertion end 51 that does not have a thread is formed. This insertion end 51 has an insertion length 51.1 that corresponds to the said distance. The insertion end of the screw shaft 29 has a thickness 45 or an outside diameter that preferably corresponds to the core diameter 47 of the thread 35. The core diameter 47 of the thread 35 preferably amounts to 10.0 mm.

The thread 35 is a single-channel right-hand thread in the form of a trapezoid thread. It is understood, however, that the thread can also be a left-hand thread. The thread 35 is a non-self-tapping thread. The thread 35 has a flank angle 44 between adjacent thread flanks 94.1, 94.2. The flank angle preferably amounts to 42 degrees. The thread 35 has a thread pitch 43 that preferably amounts to 4.0 mm. The thread 35 has a thread depth 48.1 that preferably amounts to 2.0 mm. The thread 35 is delimited, radially toward the inside or toward the longitudinal screw axis 33, by a level thread core 48, The thread core 48 runs parallel to the longitudinal screw shaft 29 and includes an outer surface 80 of the pin shaft 29. The thread 35 is delimited, radially toward the outside, by a thread tip 95 that is delimited by an outer surface that runs parallel to the longitudinal screw axis 33. The width 49 of the thread core 48 between two thread flanks 94.1 and 94.2 preferably amounts to 2.0 mm. It is understood that the thread core can also be configured differently, in other words can have a concave curvature, for example.

What is claimed is:

1. A scaffolding system in an overlap arrangement, the scaffolding system comprising:

(a) first and second decking planks having first and second decking surfaces, respectively, composed of sheet metal, the first and second decking surfaces being provided with essentially round passage holes;

wherein first passage holes of the essentially round passage holes of the first decking plank and second passage holes of the essentially round passage holes of the second decking plank are delimited by a respective beaded, circumferential first hole edge and have an inside diameter;

wherein each beaded, circumferential first hole edge is delimited circumferentially by an inside radius of a cross-section of the beaded, circumferential first hole edge that contains a passage hole axis, and wherein the inside radius amounts to a value, wherein each of the beaded, circumferential first hole edges has a hole edge height within a range from to 4 mm;

wherein the second decking plank is disposed above and overlaps the first decking plank so that the second decking surface overlaps at least partly over the first decking surface;

(b) a metal locking screw having a screw head, a pin shaft having an outer surface, a longitudinal screw axis, and a thread releasably attaching the first decking plank to the second decking plank;

wherein the thread has a thread core comprising a portion of the outer surface of the pin shaft, wherein the thread core has a width, measured in a direction of the longitudinal screw axis, between adjacent thread flanks of the thread, wherein the width is within a range from 1.5 mm to 2.5 mm;

wherein the thread has a thread pitch that amounts to a second value that is substantially equal to the value of the inside radius;

wherein said pin shaft passes through a first passage hole of the first passage holes and through a second passage hole of the second passage holes such that said screw head engages over and lies against a second hole edge of the second passage hole; and wherein the metal locking screw is configured to be screwed-in with its thread directly into at least the first passage hole without plastic deformation and without elastic widening of the beaded, circumferential first hole edge of the first passage hole so that the second decking plank and the first decking plank are braced relative to one another only via the metal locking screw, secured to prevent relative lateral displacement of the first and second decking planks in a displacement plane parallel to the first and second decking surfaces and secured to prevent separation of the first and second decking planks from one another, without using a nut being screwed onto the metal locking screw.

2. The scaffolding system according to claim 1, wherein the thread has an outside thread diameter that is within a range from 1.5 to 5.0 percent greater than the inside diameter of each of the first and second passage holes.

3. The scaffolding system according to claim 1, wherein the thread has an outside thread diameter that is 3.0 percent greater than the inside diameter of each of the first and second passage holes.

4. The scaffolding system according to claim 1, wherein the inside diameter of each of the first and second passage holes is within a range from 13.0 mm to 14.0 mm and an outside thread diameter of the thread is within a range from 13.7 mm to 14.3 mm.

5. The scaffolding system according to claim 1, wherein the inside diameter of each of the first and second passage holes is within a range from 13.2 mm to 13.6 mm and an outside thread diameter of the thread is 14.0 mm.

6. The scaffolding system according to claim 1, wherein the thread pitch is within a range from 0.25 times to 0.35 times the inside diameter of each of the first and second passage holes.

7. The scaffolding system according to claim 1, wherein the thread pitch is 0.3 times the inside diameter of each of the first and second passage holes.

8. The scaffolding system according to claim 1, wherein the thread pitch is within a range from 3.5 mm to 5.0 mm.

9. The scaffolding system according to claim 1, wherein the thread pitch is 4.0 mm.

10. The scaffolding system according to claim 1, wherein the thread has a flank angle that is within a range from 35 degrees to 50 degrees.

11. The scaffolding system according to claim 1, wherein the thread has a flank angle that is 42 degrees.

12. The scaffolding system according to claim 1, wherein the thread core has a core diameter within a range from 9 mm to 11 mm.

13. The scaffolding system according to claim 1, wherein the width of the thread core is 2 mm.

* * * * *